US008628347B2

(12) United States Patent
Davis et al.

(10) Patent No.: US 8,628,347 B2
(45) Date of Patent: Jan. 14, 2014

(54) CONNECTOR ASSEMBLY HAVING ALIGNMENT FEATURES

(75) Inventors: Wayne Samuel Davis, Harrisburg, PA (US); Robert Neil Whiteman, Jr., Middletown, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 29 days.

(21) Appl. No.: 13/396,434

(22) Filed: Feb. 14, 2012

(65) Prior Publication Data

US 2013/0210265 A1 Aug. 15, 2013

(51) Int. Cl.
*H01R 13/62* (2006.01)

(52) U.S. Cl.
USPC ..... 439/374

(58) Field of Classification Search
USPC ..... 439/374
See application file for complete search history.

(56) References Cited

U.S. PATENT DOCUMENTS 2,227,743 A * 1/1941 Bone et al. ..... 439/374
3,264,599 A * 8/1966 Kinkaid ..... 439/374
3,966,290 A * 6/1976 Little et al. ..... 439/74
4,274,693 A * 6/1981 Cobaugh et al. ..... 439/374
4,350,401 A * 9/1982 Allen et al. ..... 439/374
4,986,758 A * 1/1991 Wakata ..... 439/595
5,030,130 A * 7/1991 Natsume ..... 439/374
5,037,323 A * 8/1991 Locati ..... 439/374
5,129,831 A * 7/1992 Locati ..... 439/79
5,137,467 A * 8/1992 Arai ..... 439/374
5,147,225 A * 9/1992 Kile et al. ..... 439/680
5,637,019 A * 6/1997 Crane et al. ..... 439/677
5,655,914 A * 8/1997 McCartin et al. ..... 439/78
5,718,593 A * 2/1998 Figueiredo et al. ..... 439/76.1
8,292,659 B2 * 10/2012 Tuin ..... 439/540.1

* cited by examiner

*Primary Examiner* — Gary Paumen

(57) ABSTRACT

A connector assembly includes a housing having a mating end being configured for mating with a mating connector assembly. The housing holds a plurality of contacts configured for mating with corresponding contacts of the mating connector assembly. The housing has horizontal alignment features at the mating end for horizontally aligning the housing with the mating connector assembly. The housing has vertical alignment features at the mating end for vertically aligning the housing with the mating connector assembly. The vertical alignment features are separate from the horizontal alignment features.

20 Claims, 2 Drawing Sheets

CONNECTOR ASSEMBLY HAVING ALIGNMENT FEATURES

BACKGROUND OF THE INVENTION

The subject matter herein relates generally to a connector assembly having alignment features.

Some electrical connector systems utilize electrical connectors to interconnect two circuit boards, such as a motherboard and daughtercard. Signal loss and/or signal degradation is a problem in known electrical systems. For example, cross talk results from an electromagnetic coupling of the fields surrounding an active conductor or differential pair of conductors and an adjacent conductor or differential pair of conductors. The strength of the coupling generally depends on the separation between the conductors, thus, cross talk may be significant when the electrical connectors are placed in close proximity to each other. Moreover, as speed and performance demands increase, known electrical connectors are proving to be insufficient.

Additionally, there is a desire to increase the density of electrical connectors to increase throughput of the electrical system, without an appreciable increase in size of the electrical connectors, and in some cases, with a decrease in size of the electrical connectors. Such increase in density and/or reduction in size causes further strains on performance. Due to the large number of contacts of the electrical connectors, mating the electrical connectors is difficult. For example, aligning the contacts during mating is difficult. Misalignment in the horizontal and/or vertical direction can cause damage to the contacts or the housings. Some known connectors include alignment features that have compound angles for aligning in both the horizontal direction and the vertical direction simultaneously. However, using a single alignment feature for alignment in both the x and y directions is difficult and may cause the thin walls supporting the alignment feature to bend outward rather than causing the electrical connector to move into alignment.

A need remains for an electrical connector having improved alignment features to help align the electrical connectors during mating.

BRIEF DESCRIPTION OF THE INVENTION

In one embodiment, a connector assembly is provided including a housing having a mating end being configured for mating with a mating connector assembly. The housing holds a plurality of contacts configured for mating with corresponding contacts of the mating connector assembly. The housing has horizontal alignment features at the mating end for horizontally aligning the housing with the mating connector assembly. The housing has vertical alignment features at the mating end for vertically aligning the housing with the mating connector assembly. The vertical alignment features are separate from the horizontal alignment features.

Optionally, the horizontal alignment features may have angled lead-in surfaces and the vertical alignment features may have angled lead-in surfaces. The housing may have a front at the mating end that extends along a plane in vertical and horizontal directions. The horizontal alignment features may have angled lead-in surfaces angled with respect to the front and the vertical alignment features may have angled lead-in surfaces angled with respect to the front.

Optionally, the housing may have a top, a bottom, a first side and a second side at the mating end. The horizontal alignment features may be approximately centrally positioned along the top and bottom between the first and second sides. The vertical alignment features may be positioned along the top and bottom at the first and second sides. The horizontal alignment features may includes lugs extending along the top and bottom that have angled lead-in surfaces angled to face forward and outward toward either the first side or the second side. The horizontal alignment features may include lugs defining a slot where the lugs have angled lead-in surfaces angled to face forward and inward toward the slot to guide a corresponding alignment feature of the mating connector assembly into the slot to horizontally position the housing with respect to the mating connector assembly. The vertical alignment features may have ramps extending along the top and bottom with angled lead-in surfaces angled to face forward and either upward or downward. The vertical alignment features may be positioned forward of the horizontal alignment features to engage the mating connector assembly prior to the horizontal alignment features engaging the mating connector assembly.

In another embodiment, an electrical connector system is provided having a receptacle assembly and a header assembly. The receptacle assembly includes a receptacle housing having a mating end and a loading end. The receptacle housing has contact channels at the mating end. The receptacle housing receives a plurality of contact modules through the loading end. Each contact module has a dielectric frame holding a plurality of receptacle signal contacts. The receptacle signal contacts have mating portions extending forward from a front of the dielectric frame for loading into corresponding contact channels of the receptacle housing. The header assembly includes a header housing having a base wall and shroud walls extending from the base wall and defining a chamber. The chamber receives the receptacle assembly therein. The header housing holds a plurality of header signal contacts received in corresponding contact channels of the receptacle housing and mated to corresponding receptacle signal contacts. The receptacle housing and the header housing have horizontal alignment features and vertical alignment features for aligning the receptacle and header housings in a horizontal direction and in a vertical direction, respectively. The vertical alignment features are separate from the horizontal alignment features.

DETAILED DESCRIPTION OF THE INVENTION

Figure 1:
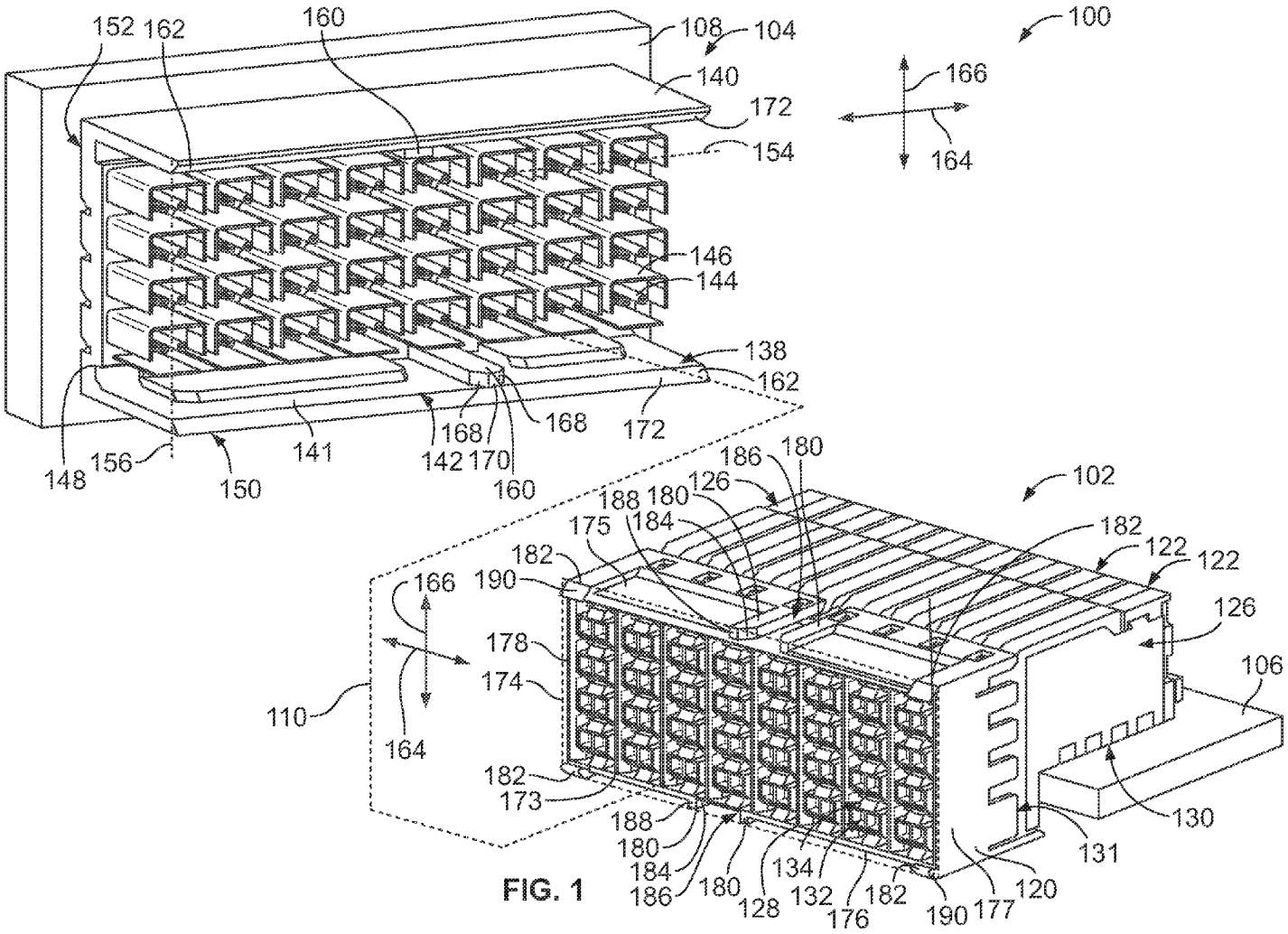
FIG. 1 is a perspective view of an electrical connector system illustrating a receptacle assembly and a header assembly formed in an exemplary embodiment.

FIG. 1 is a perspective view of an exemplary embodiment of an electrical connector system 100 illustrating a receptacle assembly 102 and a header assembly 104 that may be directly mated together. The receptacle assembly 102 and/or the header assembly 104 may be referred to hereinafter individually as a "connector assembly" or a "mating connector assembly" and may be referred to collectively as "connector assemblies" or "mating connector assemblies".

The receptacle and header assemblies 102, 104 are each electrically connected to respective circuit boards 106, 108. The receptacle and header assemblies 102, 104 are utilized to electrically connect the circuit boards 106, 108 to one another at a separable mating interface. In an exemplary embodiment, the circuit boards 106, 108 are oriented perpendicular to one another when the receptacle and header assemblies 102, 104 are mated. Alternative orientations of the circuit boards 106, 108 are possible in alternative embodiments. A mating axis 110 extends through the receptacle and header assemblies 102, 104. The receptacle and header assemblies 102, 104 are mated together in a direction parallel to and along the mating axis 110.

The receptacle assembly 102 includes a receptacle housing 120 that holds a plurality of contact modules 122. Any number of contact modules 122 may be provided to increase the density of the receptacle assembly 102. The contact modules 122 each include a plurality of receptacle signal contacts 124 (shown in FIG. 2) that are received in the receptacle housing 120 for mating with the header assembly 104. In an exemplary embodiment, each contact module 122 has a shield structure 126 for providing electrical shielding for the receptacle signal contacts 124. In an exemplary embodiment, the shield structure 126 is electrically connected to the header assembly 104 and/or the circuit board 106. For example, the shield structure 126 may be electrically connected to the header assembly 104 by extensions (e.g. beams or fingers) extending from the contact modules 122 that engage the header assembly 104. The shield structure 126 may be electrically connected to the circuit board 106 by features, such as ground pins.

The receptacle assembly 102 includes a mating end 128 and a mounting end 130. The receptacle signal contacts 124 are received in the receptacle housing 120 and held therein at the mating end 128 for mating to the header assembly 104. The receptacle signal contacts 124 are arranged in a matrix of rows and columns. In the illustrated embodiment, at the mating end 128, the rows are oriented horizontally and the columns are oriented vertically. Other orientations are possible in alternative embodiments. Any number of receptacle signal contacts 124 may be provided in the rows and columns. The receptacle signal contacts 124 also extend to the mounting end 130 for mounting to the circuit board 106. Optionally, the mounting end 130 may be substantially perpendicular to the mating end 128.

The receptacle housing 120 defines the mating end 128 of the receptacle assembly 102. The receptacle housing 120 also includes a loading end 131 at a rear of the receptacle housing 120. The contact modules 122 are loaded into the receptacle housing 120 through the loading end 131. In the illustrated embodiment, the contact modules 122 extend beyond (e.g. rearward from) the loading end 131.

The receptacle housing 120 includes a plurality of signal contact openings 132 and a plurality of ground contact openings 134 at the mating end 128. The receptacle signal contacts 124 are received in corresponding signal contact openings 132. Optionally, a single receptacle signal contact 124 is received in each signal contact opening 132. The signal contact openings 132 may also receive corresponding header signal contacts 144 therein when the receptacle and header assemblies 102, 104 are mated. The ground contact openings 134 receive header shields 146 therein when the receptacle and header assemblies 102, 104 are mated. The ground contact openings 134 receive grounding beams 302 (shown in FIG. 2) of the contact modules 122 that mate with the header shields 146 to electrically common the receptacle and header assemblies 102, 104.

The receptacle housing 120 is manufactured from a dielectric material, such as a plastic material, and provides isolation between the signal contact openings 132 and the ground contact openings 134. The receptacle housing 120 isolates the receptacle signal contacts 124 and the header signal contacts 144 from the header shields 146. The receptacle housing 120 isolates each set of receptacle and header signal contacts 124, 144 from other sets of receptacle and header signal contacts 124, 144.

The header assembly 104 includes a header housing 138 having top and bottom shroud walls 140, 141 defining a chamber 142. The top and bottom shroud walls 140, 141 extend between opposite sides of the header housing 138. The header assembly 104 has a mating end 150 and a mounting end 152 that is mounted to the circuit board 108. Optionally, the mounting end 152 may be substantially parallel to the mating end 150. The receptacle assembly 102 is received in the chamber 142 through the mating end 150. The receptacle housing 120 engages the shroud walls 140, 141 to hold the receptacle assembly 102 in the chamber 142. The header signal contacts 144 and the header shields 146 extend from a base wall 148 into the chamber 142. The header signal contacts 144 and the header shields 146 extend through the base wall 148 and are mounted to the circuit board 108.

In an exemplary embodiment, the header signal contacts 144 are arranged as differential pairs. The header signal contacts 144 are arranged in rows along row axes 154. The pairs of header signal contacts 144 are oriented along the row axes 154. In an exemplary embodiment, the header assembly 104 is oriented such that the row axes 154 are oriented horizontally along in an X-direction. The header signal contacts 144 are arranged in columns along column axes 156. In an exemplary embodiment, the header assembly 104 is oriented such that the column axes 156 are oriented vertically in a Y-direction.

The header shields 146 are positioned between the differential pairs to provide electrical shielding between adjacent differential pairs. In the illustrated embodiment, the header shields 146 are C-shaped and provide shielding on three sides of the pair of header signal contacts 144. The bottom is open between the sides of the header shield 146. The header shield 146 associated with another pair of header signal contacts 144 provides the shielding along the open, fourth side thereof such that each of the pairs of signal contacts 144 is shielded from each adjacent pair in the same column and the same row. Other configurations or shapes for the header shields 146 are possible in alternative embodiments. More or less walls may be provided in alternative embodiments. The walls may be bent or angled rather than being planar. In other alternative embodiments, the header shields 146 may provide shielding for individual signal contacts 144 or sets of contacts having more than two signal contacts 144.

The header housing 138 includes alignment features for aligning the header housing 138 with the receptacle housing 120 during mating. In an exemplary embodiment, the header housing 138 includes both horizontal alignment features 160 and vertical alignment features 162 at the mating end 150. The horizontal alignment features 160 horizontally align the header housing 138 with the receptacle housing 120 during mating along an X-axis 164. The vertical alignment features 162 vertically align the header housing 138 with the receptacle housing 120 during mating along a Y-axis 166. The horizontal and vertical alignment features 160, 162 are separate from one another. Compound surfaces of conventional alignment features are avoided, which tend to bend the thin walls of the housings of conventional housings.

In an exemplary embodiment, the horizontal alignment features 160 are positioned on the top and bottom of the header housing 138, such as along the top shroud wall 140 and the bottom shroud wall 141. The horizontal alignment features 160 may be approximately centrally located between the sides of the header housing 138. Optionally, the horizontal alignment feature 160 on the top shroud wall 140 may be offset with respect to the horizontal alignment feature 160 on the bottom shroud wall 141 to function as keying features to ensure that the header housing 138 and receptacle housing 120 are mated in the proper orientation.

The horizontal alignment features 160 include angled lead-in surfaces 168 that guide the header housing 138 and receptacle housing 120 into proper positions during mating. The surfaces 168 may shift the header housing 138 and/or the receptacle housing 120 horizontally (e.g. right or left) during mating. In an exemplary embodiment, the horizontal alignment features 160 include at least two surfaces 168 that face in different directions to guide mating either left or right into proper alignment. The surfaces 168 are angled with respect to the front of the header housing 138. The surfaces 168 are generally forward facing and outward facing toward either side of the header housing 138.

The horizontal alignment features 160 constitute lugs, and may be referred to hereinafter as lugs 160. The lugs 160 extend inward from the top and bottom shroud walls 140, 141. The lugs 160 are positioned proximate to the mating end 150. In an exemplary embodiment, a front or tip of each lug 160 includes a butting surface 170 which is oriented generally parallel to the front of the header housing 138. The butting surface 170 prevents mating with the receptacle housing 120 when the receptacle housing 120 and the header housing 138 are mis-aligned beyond a threshold amount (e.g. too far out of alignment for the alignment features to register and function to align the housings). The lugs 160 force the receptacle housing 120 horizontally (e.g. to the right or to the left) to center the receptacle housing 120 in the chamber 142.

In an exemplary embodiment, the vertical alignment features 162 are positioned on the top and bottom of the header housing 138, such as along the top shroud wall 140 and the bottom shroud wall 141. The vertical alignment features 162 may extend entirely across the front of the header housing 138 between the opposite sides of the header housing 138. Alternatively, the vertical alignment features 162 may be positioned at discrete locations along the top and bottom shroud walls 140, 141. For example, the vertical alignment features 162 may be positioned at the outer edges of the top and bottom shroud walls 140, 141. The vertical alignment features 162 are separate and discrete features from the horizontal alignment features 160. The horizontal alignment is done with a different part of the header housing 138 than the vertical alignment. In an exemplary embodiment, the horizontal and vertical alignment features 160, 162 are formed integral with the header housing 138, such as formed during a common molding process, but are positioned at different locations.

The vertical alignment features 162 include angled lead-in surfaces 172 that guide the header housing 138 and receptacle housing 120 into proper positions during mating. The surfaces 172 may shift the header housing 138 and/or the receptacle housing 120 vertically (e.g. upward or downward) during mating. In an exemplary embodiment, the vertical alignment features 162 include at least two surfaces 172 that face in different directions to guide mating either upward or downward into proper alignment. The surfaces 172 are angled with respect to the front of the header housing 138. The surfaces 172 are generally forward facing and inward facing, such as either downward facing if on the top shroud wall 140 or upward facing if on the bottom shroud wall 141.

The vertical alignment features 162 constitute ramps, and may be referred to hereinafter as ramps 162. The ramps 162 are formed at the front edge of the top and bottom shroud walls 140, 141. The ramps 162 are positioned at the mating end 150. The ramps 162 force the receptacle housing 120 vertically either downward or upward into the chamber 142.

The receptacle housing 120 has a front 173 at the mating end 128. The front 173 is generally planar defined by a mating plane 174. The receptacle housing 120 extends rearward from the front 173. The receptacle housing 120 has an outer perimeter at the mating end 128 defined by a top 175, a bottom 176, a first side 177 and a second side 178.

The receptacle housing 120 includes alignment features for aligning the receptacle housing 120 with the header housing 138 during mating. In an exemplary embodiment, the receptacle housing 120 includes both horizontal alignment features 180 and vertical alignment features 182 at the mating end 128. The horizontal alignment features 180 horizontally align the receptacle housing 120 with the header housing 138 during mating along the X-axis 164. The vertical alignment features 182 vertically align the receptacle housing 120 with the header housing 138 during mating along the Y-axis 166.

In an exemplary embodiment, the horizontal alignment features 180 are positioned on the top and bottom of the receptacle housing 120, such as along the top 175 and the bottom 176. The horizontal alignment features 180 may be approximately centrally located between the sides 177, 178 of the receptacle housing 120. Optionally, the horizontal alignment feature 180 on the top 175 may be offset with respect to the horizontal alignment feature 180 on the bottom 176 to function as keying features to ensure that the receptacle housing 120 and header housing 138 are mated in the proper orientation.

The horizontal alignment features 180 include angled lead-in surfaces 184 that guide the receptacle housing 120 and header housing 138 into proper positions during mating. The surfaces 184 may shift the receptacle housing 120 and/or the header housing 138 horizontally (e.g. right or left) during mating. In an exemplary embodiment, a pair of horizontal alignment features 180 are grouped together to define a slot 186 therebetween. The slot 186 receives the lug 160. The horizontal alignment features 180 have two surfaces 184 that face inward toward the slot 186 to guide the lug 160 into proper alignment. The surfaces 184 engage the surfaces 168 of the lug 160 to move the header housing 138 and/or the receptacle housing 120 either right or left to align the lug 160 with the slot 186. The surfaces 184 are angled with respect to the front 173 of the receptacle housing 120. The surfaces 184 are generally forward facing and inward facing toward the slot 186.

The horizontal alignment features 180 constitute lugs, and may be referred to hereinafter as lugs 180. The lugs 180 extend outward from the top 175 and bottom 176. The lugs 180 are positioned proximate to the mating end 150. In an exemplary embodiment, a front or tip of each lug 180 includes a butting surface 188 which is oriented generally parallel to the front 173 of the receptacle housing 120. The butting surface 188 prevents mating with the receptacle housing 120 when the header housing 138 and the receptacle housing 120 are mis-aligned beyond a threshold amount (e.g. too far out of alignment for the alignment features to register and function to align the housings). The lugs 180 force the lugs 160 horizontally (e.g. to the right or to the left) to center the lugs 160 in the slot 186.

In an exemplary embodiment, the vertical alignment features 182 are positioned on the top 175 and bottom 176. The vertical alignment features 182 are positioned at discrete locations along the top 175 and bottom 176. For example, the vertical alignment features 182 may be positioned at or near the sides 177, 178. The vertical alignment features 182 may be positioned at other locations in alternative embodiments. The vertical alignment features 182 are separate and discrete features from the horizontal alignment features 180. The horizontal alignment is done with a different part of the receptacle housing 120 than the vertical alignment. In an exemplary embodiment, the horizontal and vertical alignment features 180, 182 are formed integral with the receptacle housing 120, such as formed during a common molding process, but are positioned at different locations.

The vertical alignment features 182 include angled lead-in surfaces 190 that guide the receptacle housing 120 and header housing 138 into proper positions during mating. The surfaces 190 may shift the receptacle housing 120 and/or the header housing 138 vertically (e.g. upward or downward) during mating. In an exemplary embodiment, the vertical alignment features 182 include at least two surfaces 190 that face in different directions to guide mating either upward or downward into proper alignment. The surfaces 190 are angled with respect to the front 173 of the receptacle housing 120. The surfaces 190 are generally forward facing and outward facing, such as either upward facing if on the top 175 or downward facing if on the bottom 176.

The vertical alignment features 182 constitute ramps, and may be referred to hereinafter as ramps 182. The ramps 182 are formed at the front 173 of the top 175 and bottom 176. The ramps 182 engage the ramps 162 to align the receptacle housing 120 with the header housing 138. Optionally, the ramps 182 may extend forward from the front 173 beyond the mating plane 174. The ramps 182 are positioned forward of the lugs 180. The ramps 182 force the receptacle housing 120 vertically either downward or upward to center the receptacle housing 120 in the chamber 142.

Figure 2:
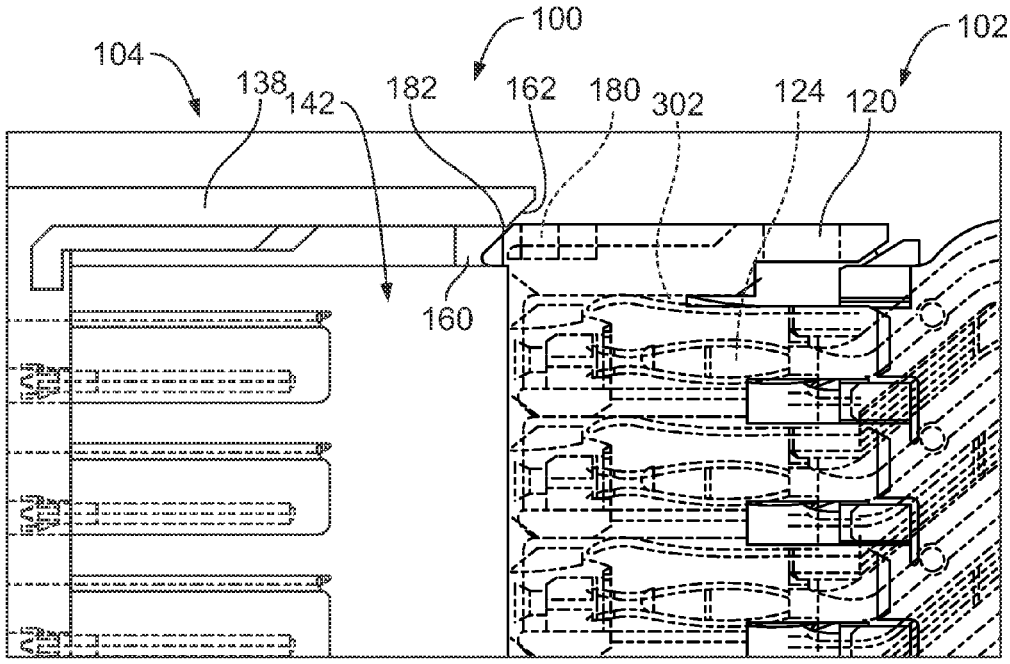
FIG. 2 is a side view of the electrical connector system illustrating an upper portion of the receptacle assembly partially mated with the header assembly.

FIG. 2 is a side view of the electrical connector system 100 illustrating an upper portion of the receptacle assembly 102 partially mated with the header assembly 104. In an exemplary embodiment, the vertical alignment features 162, 182 are positioned forward of the horizontal alignment features 160, 180 (shown in phantom). The vertical alignment features 162, 182 engage each other prior to the horizontal alignment features 160, 180 engaging each other. As such, the vertical alignment of the receptacle assembly 102 and the header assembly 104 is accomplished prior to the horizontal alignment features 160, 180 engaging each other. The vertical alignment features 162, 182 ensure that the horizontal alignment features 160, 180 are coplanar when the horizontal alignment features 160, 180 initially engage. The staged mating sequence ensures aligning movement along only one axis at a time.

The upper vertical alignment feature 182 of the receptacle assembly 102 is upward facing (the lower vertical alignment features 182 are illustrated in FIG. 1 and are downward facing) and is angled toward the header assembly 104. The vertical alignment feature 182 defines a ramp that rides along the vertical alignment feature 162 to force the receptacle housing 120 into the chamber 142 of the header housing 138.

Figure 3:
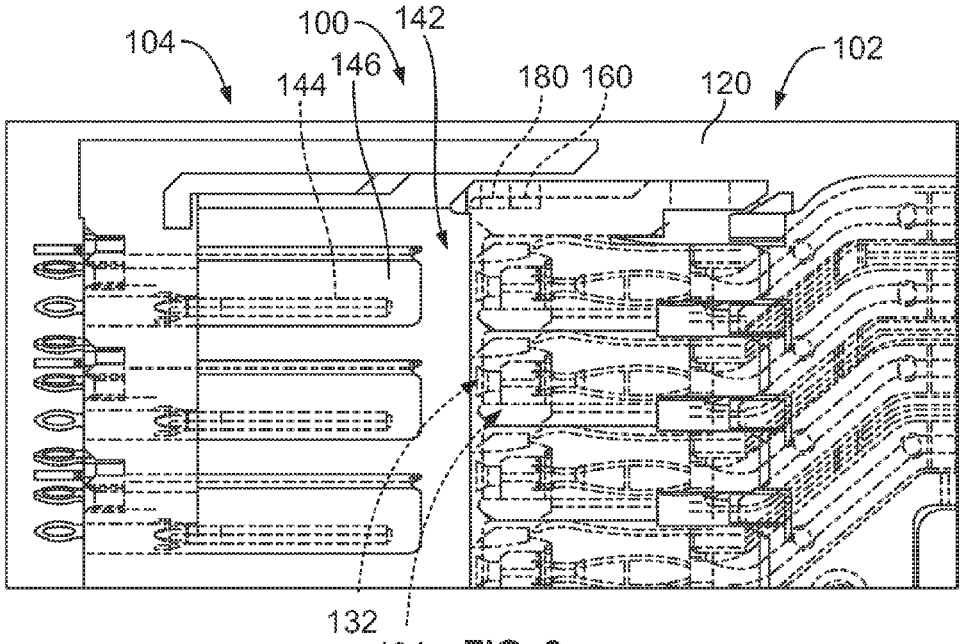
FIG. 3 is a side view of the electrical connector system illustrating an upper portion of the receptacle assembly partially mated with the header assembly.

FIG. 3 is a side view of the electrical connector system 100 illustrating an upper portion of the receptacle assembly 102 partially mated with the header assembly 104. The receptacle assembly 102 is illustrated further mated than in FIG. 2. The horizontal alignment features 180 (shown in phantom) of the receptacle assembly 102 are engaged with the horizontal alignment features 160 (shown in phantom) of the header assembly 104. The angled surfaces of the horizontal alignment features 160, 180 position the receptacle housing 120 side-to-side in the chamber 142.

The horizontal alignment features 160, 180 engage each other prior to the header ground shields 146 and header signal contacts 144 (shown in phantom) being loaded into the receptacle housing 120. As such, the horizontal alignment of the receptacle assembly 102 and the header assembly 104 is accomplished prior to the header ground shields 146 and header signal contacts 144 being loaded into the signal contact openings 132 and the ground contact openings 134 (both shown in FIG. 1).

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. An electrical connector system comprising:

a receptacle assembly comprising a receptacle housing having a mating end and a loading end, the receptacle housing having contact openings at the mating end, the receptacle housing receiving a plurality of contact modules through the loading end, each contact module comprising a plurality of receptacle signal contacts, the receptacle signal contacts having mating portions loaded into corresponding contact openings of the receptacle housing; and a header assembly comprising a header housing having a base wall and shroud walls extending from the base wall and defining a chamber, the chamber receives the receptacle assembly therein, the header housing holding a plurality of header signal contacts received in corresponding contact openings of the receptacle housing and mated to corresponding receptacle signal contacts, wherein the header housing has a top shroud wall, a bottom shroud wall, a first side and a second side at the mating end;

wherein the receptacle housing and the header housing have horizontal alignment features and vertical alignment features for aligning the receptacle and header housings in a horizontal direction and in a vertical direction, respectively, the vertical alignment features being separate from the horizontal alignment features, the horizontal alignment features of the header housing comprising lugs extending along the top and bottom shroud walls, the lugs having angled lead-in surfaces angled to face forward and outward toward either the first side or the second side.

2. The electrical connector system of claim 1, wherein the horizontal alignment features comprise angled lead-in surfaces and the vertical alignment features comprise angled lead-in surfaces.

3. The electrical connector system of claim 1, wherein the receptacle housing has a front at the mating end that extends along a plane in vertical and horizontal directions, the horizontal alignment features of the receptacle housing having angled lead-in surfaces angled with respect to the front and the vertical alignment features of the receptacle housing having angled lead-in surfaces angled with respect to the front.

4. The electrical connector system of claim 1, wherein the receptacle housing has a front at the mating end that extends along a plane in vertical and horizontal directions, the horizontal alignment features of the header housing having angled lead-in surfaces angled with respect to the front of the receptacle housing and the vertical alignment features of the header housing having angled lead-in surfaces angled with respect to the front of the receptacle housing.

5. The electrical connector system of claim 1, wherein the receptacle housing has a top, a bottom, a first side and a second side at the mating end, the horizontal alignment features of the receptacle housing being approximately centrally positioned along the top and bottom between the first and second sides, the vertical alignment features of the receptacle housing being positioned along the top and bottom at the first and second sides.

6. The electrical connector system of claim 1, wherein the header housing has a top shroud wall, a bottom shroud wall, a first side and a second side at the mating end, the horizontal alignment features of the header housing being approximately centrally positioned along the top and bottom shroud walls between the first and second sides, the vertical alignment features of the header housing being positioned along the top and bottom shroud walls at or near the first and second sides.

7. The electrical connector system of claim 1, wherein the receptacle housing has a front, a top, a bottom, a first side and a second side at the mating end, the horizontal alignment features of the receptacle housing comprising lugs extending along the top and bottom defining a slot therebetween, the lugs having angled lead-in surfaces angled to face forward and inward toward the slot.

8. The electrical connector system of claim 1, wherein the horizontal alignment features of the receptacle housing comprise lugs defining a slot, the lugs having angled lead-in surfaces angled to face forward and inward toward the slot to guide the corresponding horizontal alignment features of the header assembly into the slot to horizontally position the receptacle housing with respect to the header housing.

9. The electrical connector system of claim 1, wherein the receptacle housing has a front, a top, a bottom, a first side and a second side at the mating end, the vertical alignment features of the receptacle housing comprising ramps extending along the top and bottom, the ramps having angled lead-in surfaces angled to face forward and either upward or downward.

10. The electrical connector system of claim 1, wherein the header housing has a top shroud wall, a bottom shroud wall, a first side and a second side at the mating end, the vertical alignment features of the header housing comprising ramps extending along the top and bottom shroud walls, the ramps having angled lead-in surfaces angled to face forward and either upward or downward.

11. An electrical connector system comprising:

a receptacle assembly comprising a receptacle housing having a mating end and a loading end, the receptacle housing having contact openings at the mating end, the receptacle housing receiving a plurality of contact modules through the loading end, each contact module comprising a plurality of receptacle signal contacts, the receptacle signal contacts having mating portions loaded into corresponding contact openings of the receptacle housing; and a header assembly comprising a header housing having a base wall and shroud walls extending from the base wall and defining a chamber, the chamber receives the receptacle assembly therein, the header housing holding a plurality of header signal contacts received in corresponding contact openings of the receptacle housing and mated to corresponding receptacle signal contacts;

wherein the receptacle housing and the header housing have horizontal alignment features and vertical alignment features for aligning the receptacle and header housings in a horizontal direction and in a vertical direction, respectively, the vertical alignment features being separate from the horizontal alignment features, and wherein the vertical alignment features of the receptacle housing are positioned forward of the horizontal alignment features of the receptacle housing to engage the vertical alignment features of the header housing prior to the horizontal alignment features of the receptacle housing engaging the horizontal alignment features of the header housing.

12. The electrical connector system of claim 11, wherein the horizontal alignment features comprise angled lead-in surfaces and the vertical alignment features comprise angled lead-in surfaces.

13. The electrical connector system of claim 11, wherein the receptacle housing has a front at the mating end that extends along a plane in vertical and horizontal directions, the horizontal alignment features of the receptacle housing having angled lead-in surfaces angled with respect to the front and the vertical alignment features of the receptacle housing having angled lead-in surfaces angled with respect to the front.

14. The electrical connector system of claim 11, wherein the receptacle housing has a front at the mating end that extends along a plane in vertical and horizontal directions, the horizontal alignment features of the header housing having angled lead-in surfaces angled with respect to the front of the receptacle housing and the vertical alignment features of the header housing having angled lead-in surfaces angled with respect to the front of the receptacle housing.

15. The electrical connector system of claim 11, wherein the receptacle housing has a top, a bottom, a first side and a second side at the mating end, the horizontal alignment features of the receptacle housing being approximately centrally positioned along the top and bottom between the first and second sides, the vertical alignment features of the receptacle housing being positioned along the top and bottom at the first and second sides.

16. The electrical connector system of claim 11, wherein the header housing has a top shroud wall, a bottom shroud wall, a first side and a second side at the mating end, the horizontal alignment features of the header housing being approximately centrally positioned along the top and bottom shroud walls between the first and second sides, the vertical alignment features of the header housing being positioned along the top and bottom shroud walls at or near the first and second sides.

17. The electrical connector system of claim 11, wherein the receptacle housing has a front, a top, a bottom, a first side and a second side at the mating end, the horizontal alignment features of the receptacle housing comprising lugs extending along the top and bottom defining a slot therebetween, the lugs having angled lead-in surfaces angled to face forward and inward toward the slot.

18. The electrical connector system of claim 11, wherein the horizontal alignment features of the receptacle housing comprise lugs defining a slot, the lugs having angled lead-in surfaces angled to face forward and inward toward the slot to guide the corresponding horizontal alignment features of the header assembly into the slot to horizontally position the receptacle housing with respect to the header housing.

19. The electrical connector system of claim 11, wherein the receptacle housing has a front, a top, a bottom, a first side and a second side at the mating end, the vertical alignment features of the receptacle housing comprising ramps extending along the top and bottom, the ramps having angled lead-in surfaces angled to face forward and either upward or downward.

20. The electrical connector system of claim 11, wherein the header housing has a top shroud wall, a bottom shroud wall, a first side and a second side at the mating end, the vertical alignment features of the header housing comprising ramps extending along the top and bottom shroud walls, the ramps having angled lead-in surfaces angled to face forward and either upward or downward.

* * * * *